United States Patent [19]

Feighan

[11] 4,181,234

[45] Jan. 1, 1980

[54] BASKET CONSTRUCTION

[76] Inventor: Sean F. Feighan, P.O. Box 35, Broadway Station, Newport, R.I. 02840

[21] Appl. No.: 12,361

[22] Filed: Feb. 15, 1979

[51] Int. Cl.[2] ..... B65D 9/10

[52] U.S. Cl. ..... 217/122; 47/67; 150/48; 248/318; 211/113

[58] Field of Search ..... 217/122, 123; 248/318; 211/113, 128; 150/48, 50, 51; 47/67

[56] References Cited

U.S. PATENT DOCUMENTS

| | | | |
|---|---|---|---|
| 282,516 | 8/1883 | Hallock | 217/123 |
| 1,331,680 | 2/1920 | Sherwood | 248/318 |
| 1,525,899 | 2/1925 | Tippit | 248/318 X |
| 1,989,473 | 1/1935 | Costigan | 217/122 |
| 2,488,715 | 11/1949 | Eggl | 217/122 |
| 3,854,242 | 12/1974 | Gladstein | 248/318 X |

*Primary Examiner*—Donald F. Norton
*Attorney, Agent, or Firm*—Robert J. Doherty

[57] ABSTRACT

An improved basket construction is disclosed in which the sidewall of a conventionally constructed basket of interwoven strand material is provided with a plurality of stiff yet somewhat bendable wire rods vertically disposed within vertical spaces formed from laterally offset runs of such strand material. The ends of the wire rods are radially outwardly bent so as to encompass at least two of the runs forming the top sidewall edge so as to clench them into position and prevent them from unravelling. Also, some of the wire rods terminate in enlarged top loops which serve as attachment points to a line for suspending the baskets for hanging and the like.

8 Claims, 7 Drawing Figures

BASKET CONSTRUCTION

BACKGROUND AND SUMMARY OF THE INVENTION

This invention relates to basket constructions and particularly to an improved basket construction which enables such baskets to be more quickly and easily assembled and yet result in a finished construction which is both attractive and durable. Additionally, the improved construction of the present invention enables baskets to be assembled either singly or in tiered relation through the provision of a novel suspension mechanism.

Baskets woven from fibrous material strands, i.e. wicker, etc., are extremely well-known and have been crafted for ages. Normally, such baskets include a sidewall construction which is made up of one or a plurality of strands of material interwoven as when wet and flexible so as to present a plurality of runs in contact with each other at spaced peripheral portions as the height of the sidewall is progressively woven and which also are laterally offset or spaced from each other at positions or sets disposed between such peripherally spaced contact points. Generally, vertically extending members projecting upwardly from the bottom and fixed thereto in some conventional manner provide guides for passing the strands over and under or in front or behind such upright members. When the desired sidewall height is reached, the upright members are bent over and interwoven downwardly so as to secure the top edge of the structure when the material of which the basket is formed, dries and accordingly becomes relatively stiff and inflexible.

Inasmuch as such methods require a considerable degree of manual dexterity and care in manipulating the materials during weaving, it would be desirable to achieve baskets of a similar construction, yet with less care and dexterity. Also, inasmuch as baskets of this type are also suspended in use for containment of flowers or other decorative matter and the storage of vegetables and the like, it would be desirable to provide an improved manner of suspending such baskets either singly or in tiered relationship without resorting to complex handle constructions or woven attachment points as is known.

Accordingly, it is an object of the present invention to provide an improved basket construction which can be more easily and quickly fabricated and yet which results in an aesthetically pleasing product which is both strong and durable.

A further object of the present invention is the provision of a novel attachment mechanism whereby baskets of the aforementioned type may be conveniently suspended by means of a line such as cord or rope in either use or for the transport for such baskets from place to place.

These and other objects of the present invention are accomplished by the use of thin, relatively stiff yet somewhat flexible rod-like supports disposed vertically through the interwoven sidewall construction of the basket and outwardly bent at the tops thereof so as to form loops which subsequently enclose two or more of the material strand runs forming the top peripheral edge of the sidewall so as to clench same into an interlocked engagement. Some of the loops so formed are of an enlarged configuration such that a line or cord may be passed therethrough and accordingly serve as an attachment point by which the basket may be manipulated or suspended during use.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
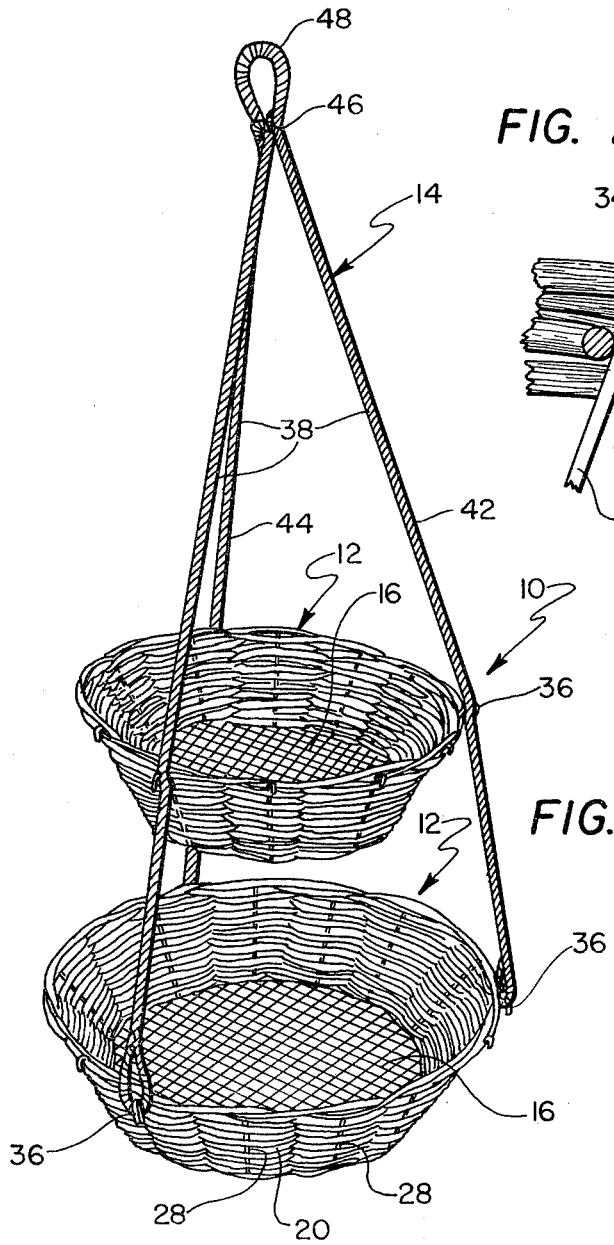
FIG. 1 is a perspective view of one form of the basket construction which the present invention may take.

Turning now to the drawing and particularly to FIG. 1 thereof, a basket construction 10 is shown in which two similarly constructed baskets 12 are shown in tiered overlying relationship to each other and suspended in such relationship by means of a rope assembly 14. Each of the baskets 12 includes a perforate bottom 16 formed from a mesh or net-like material 18. The baskets include a sidewall 20 formed of one continuous strand of fibrous material 22 or a plurality of such strands laterally interwoven about each other so as to contact adjacent strands at vertical cross over points 24 which are circumferentially spaced about the periphery of the basket and present sets 26 of laterally displaced runs therebetween.

Figure 5:
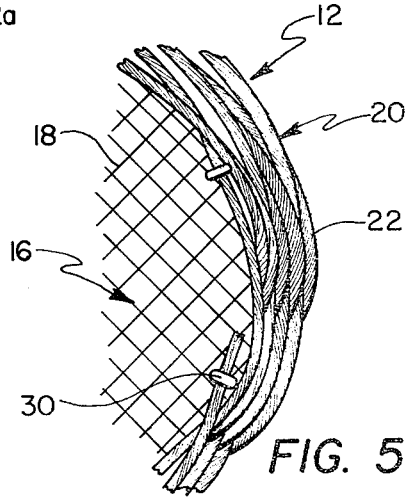
FIG. 5 is a partial bottom view of one of the baskets shown in FIG. 1.

The sidewall 20 is further provided with a plurality of circumferentially spaced rod-like supports 28 which are vertically orientated and which are disposed within the laterally displaced sets 26 in the final basket construction. These rods are preferably metal wire of relatively stiff consistency yet still bendable by the person making the basket. In this regard and as best shown in FIG. 5, the lower terminal end of each of the rods or supports 26 is bent about one or more of the individual runs 22 disposed at the bottom peripheral edge of the basket. Such bends take the form of bottom loops 30 and may clench two or more adjacent runs 22 so as to maintain such in relationship to each other and thus enable the initial construction of the basket sidewall 20. As the strands 22 are progressively interwoven about each other and alternately pass in front or in back of a particular support 28, the sidewall is progressively built up until the desired vertical height is reached. At that point, the upper terminal ends of the supports 28 are radially outwardly bent at a plurality of spaced locations so as to form a series of first loops 32 which preferably encompass two or more runs 22 forming the upper terminal edge of the basket sidewall. This serves to clench such runs 22 in a positive interlocked position in regard to each other and so as to prevent the runs from unravelling with respect to each other and so as to form a sturdy and useful basket construction. The height of the supports 28 may be predetermined so as to regulate or serve as a guide in determining the desired height of the sidewall 20.

Figure 2:
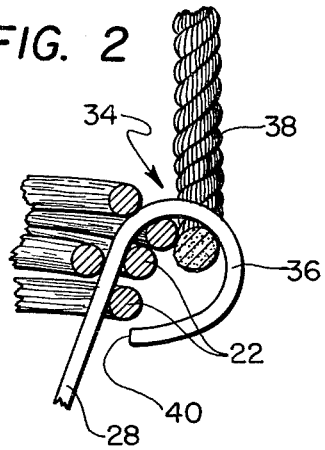
FIG. 2 is an enlarged scale partial sectional view of an enlarged loop construction present at the top edge of one of the baskets shown in FIG. 1.
Figure 3:
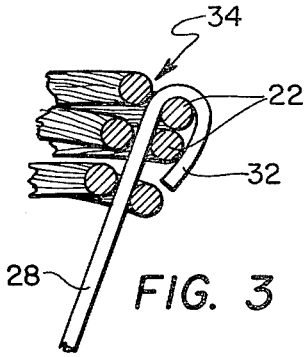
FIG. 3 is an enlarged scale partial sectional view showing a terminal loop construction at a different location along the upper terminal edge of one of the baskets of FIG. 1.
Figure 4:
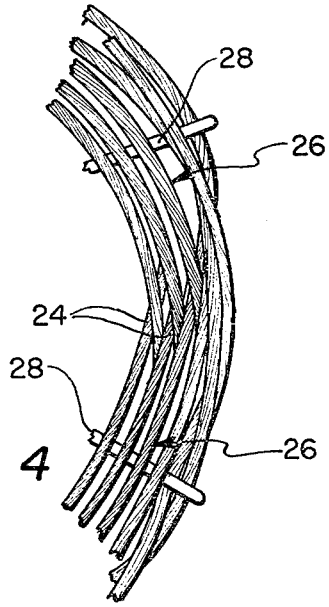
FIG. 4 is a partial plan view of one of the baskets shown in FIG. 1.

As will best be seen by simultaneous reference to FIGS. 1 and 2 of the drawing, at least two and possibly three or more of the supports 28 terminate in enlarged loops 36. Such enlarged loops 36 are formed from supports 28 that are slightly greater in height than the remainder of the supports 28 used to form the first set of loops 32. In that regard, the loops 36 initially radiate outwardly and then downwardly towards the outer surface of the sidewall 20 so as to accommodate a line or cord 38 within the confines thereof. The terminal end 40 of each such enlarged loop 36 is located proximal to or in contact with the outer surface of the sidewall 20, such that the line 38 disposed within the confines of the loop will not slip therefrom. As best shown in FIG. 1, a first running length 42 of line is doubled and attached at the opposite ends thereof to two such enlarged loops 36 arcuately spaced from each other along the top edge 34 of the lower of the baskets 12. A second length 44 of line is braided through a central portion 46 of the first running length 42 and doubled upon itself to form a loop 48 such that the basket assembly 10 may be suspended from a hook or the like.

It may be seen that such lines 38 are also simultaneously attached at upwardly spaced points to the enlarged loops 36 of the second basket in tiered relationship to the first basket 12. The enlarged loops 36 of both of the baskets 12 are also preferably spaced at equidistant points about the periphery thereof, i.e. at the 0, 120 and 240 degree areas to insure proper balance and suspension of the baskets from the rope assembly 14. In this manner then, a basket assembly 10 is provided which is suitable for the containment of vegetables such as potatoes and the like which are advantageously stored in open, i.e. aerated areas. Obviously, such basket construction 10 may be used for other purposes such as the display of ornamental plants and the like.

Figure 6:
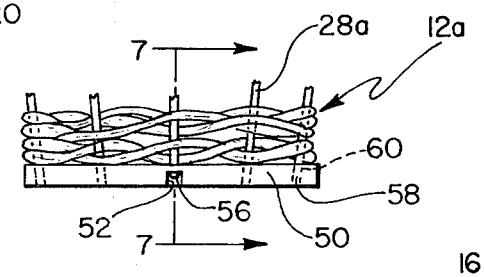
FIG. 6 is a partial side elevational view of a basket showing a modified bottom construction from those shown in FIG. 1 of the drawing.
Figure 7:
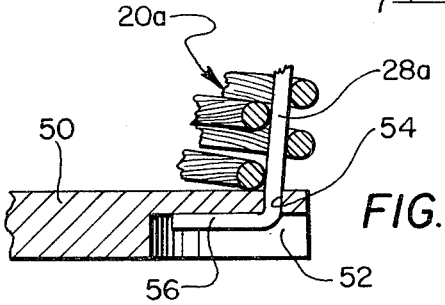
FIG. 7 is a partial sectional view taken along the line 7—7 of FIG. 6.

Turning now to FIGS. 6 and 7 of the drawing, an alternative basket construction 20 is shown in which a relatively solid bottom wall 50 is provided. Such bottom wall includes at least a pair of spaced slots or undercuts 52 disposed on the bottom surface thereof such that supports 28*a* may be projected through an opening 54 provided in such bottom wall 50 and terminate therebelow in an L-shaped bottom terminal section 56. In this manner then, the bottom 50 is secured to the sidewall 20*a* of such modified basket construction 12*a*. It is not necessary in such modified construction 12*a* that each of the supports 28 terminate in a lower L-shaped portion 56, but may terminate in a relatively straight portion 58 which in turn may be disposed within a plurality of openings 60 provided on the bottom wall 50. In other regards, the basket construction 12*a* may be similar to that aforementioned discussed in regard to the embodiment shown in FIGS. 1 through 5.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A basket comprising a vertically orientated sidewall constructed of at least one material strand interwoven so as to form runs of said strand material in adjacent vertical contact on top of each other at spaced positions about the periphery of said basket and laterally offset from each other between said spaced positions to form laterally spaced sets thereof, a plurality of relatively rigid vertically orientated rod-like supports spaced from each other around the periphery of said basket and disposed between at least some of said sets of laterally spaced runs, a first group of said supports each terminating at the upper periphery of said sidewall in a radially outwardly directed loop through which two or more vertically adjacent top edge sidewall runs are disposed in contact therewith so as to maintain said top sidewall edge runs from unravelling, a second group of said supports each terminating in an enlarged substantially closed radially outwardly directed loop passing over said top sidewall edge runs, said enlarged loop receiving a supporting line therethrough so as to support said basket in an elevated position.

2. The basket construction of claim 1, there being at least two supports in said second group thereof, said second supports substantially equally spaced from each other about the periphery of said basket.

3. The basket construction of claim 2, said basket being round and having three such second supports.

4. The basket construction of claim 3, there being interconnected three pieces of said line, each piece upwardly directed from one of said enlarged loops to a common connection point generally centrally above said basket.

5. The basket construction of claim 4, there being a second basket of similar construction to said first basket interposed between said common connection point and said first basket and suspended above said first basket by said line pieces attached to enlarged loops of said second basket.

6. The basket construction of claims 4 or 5, wherein said basket or baskets include a perforate bottom formed of an open mesh material, said basket supports terminating at their lower ends in bottom loops engaging two or more bottom sidewall edge runs, peripheral portions of said mesh further engaged by said bottom loops so as to support said bottom from said sidewall.

7. The basket construction of claim 1, said basket including a bottom wall, said basket supports terminating in said bottom wall at the lower ends thereof, at least two of said support lower ends terminating in an L-shaped terminus adapted to engage the bottom surface of said bottom wall at spaced locations thereof.

8. The basket construction of claim 1, said supports being relatively stiff wire rods which are nevertheless flexible enough to be bent into said loops.

* * * * *